US006263514B1

(12) United States Patent
Chern

(10) Patent No.: US 6,263,514 B1
(45) Date of Patent: Jul. 24, 2001

(54) SAFETY CAP

(76) Inventor: Ming-Nong Chern, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/533,275

(22) Filed: Mar. 22, 2000

(51) Int. Cl.[7] ..... A42B 1/06
(52) U.S. Cl. ..... 2/410; 2/425
(58) Field of Search ..... 2/410, 425, 412, 2/171.3

(56) References Cited

U.S. PATENT DOCUMENTS

| | | | | |
|---|---|---|---|---|
| Re. 29,742 | * | 8/1978 | Tung | 2/412 |
| 4,054,953 | * | 10/1977 | De Barsy | 2/414 |
| 4,115,874 | * | 9/1978 | Hasegawa | 2/425 |
| 4,141,085 | * | 2/1979 | Adams, Sr. | 2/410 |
| 5,014,366 | * | 5/1991 | Discipio, Sr. | 2/424 |
| 5,327,587 | * | 7/1994 | Hurwitz | 2/422 |
| 5,345,614 | * | 9/1994 | Tanaka et al. | 2/425 |
| 5,353,008 | * | 10/1994 | Eikenberry et al. | 2/422 X |

FOREIGN PATENT DOCUMENTS

| | | | | |
|---|---|---|---|---|
| 638251 | * | 2/1995 | (EP) | 2/410 |

* cited by examiner

*Primary Examiner*—Rodney Lindsey

(57) ABSTRACT

A safety cap has a bump-resisting rigid casing, a plurality of trigonal pyramid reflection devices disposed on an outer surface of the bump-resisting rigid casing, a transparent layer enclosing the outer surface of the bump-resisting rigid casing and the trigonal pyramid reflection devices, and a foamed layer disposed in the bump-resisting rigid casing. A plurality of air inlets are formed on a top front portion of the bump-resisting rigid casing. A plurality of channels are formed on a top portion of the bump-resisting rigid casing. A plurality of vent holes are formed on the top portion of the bump-resisting rigid casing. A plurality of hollow frames are inserted in the air inlets. A plurality of door plates covers the air inlets. Each door plate engages with the respective hollow frame.

9 Claims, 10 Drawing Sheets

SAFETY CAP

BACKGROUND OF THE INVENTION

The present invention relates to a safety cap. More particularly, the present invention relates to a safety cap which can protect a head of a user against a bumping force.

A conventional safety cap has a hard outer casing which is made of acrylic material and an inner layer which is made of expandable polystyrene. When the conventional safety cap is bumped, the acrylic hard outer casing cannot absorb a bumping force. The expandable polystyrene inner layer cannot absorb the bumping force effectively. Because the polystyrene inner layer separates a head of a user from the hard outer casing, the user will feel comfortable while wearing the polystyrene inner layer.

SUMMARY OF THE INVENTION

An object of the present invention is to provide a safety cap which has a PVC transparent layer to be deformed while bumping.

Another object of the present invention is to provide a safety cap which has an EVA foamed layer to be deformed elastically and to absorb shock while bumping.

Another object of the present invention is to provide a safety cap which has a bump-resisting rigid casing made of nylon material to protect the safety cap from cracking.

Another object of the present invention is to provide a safety cap which has a plurality of trigonal pyramid reflection devices in order to reflect lights.

Another object of the present invention is to provide a safety cap which has a plurality of fluorescence films disposed on surfaces of trigonal pyramid reflection devices in order to illuminate fluorescent lights.

Another object of the present invention is to provide a safety cap which has a plurality of light-emitting diodes disposed on a rear portion of a bump-resisting rigid casing in order to produce warning lights to warn passengers and vehicle drivers.

Another object of the present invention is to provide a safety cap which has a plurality of air inlets, a plurality of channels and a plurality of vent holes in order to ventilate the safety cap by opening a plurality of door plates.

Another object of the present invention is to provide a safety cap which has an oblong hole to receive a microphone and a through hole to receive an earphone in order to communicate with a mobile phone.

In accordance with a first preferred embodiment of the present invention, a safety cap comprises a bump-resisting rigid casing, a plurality of trigonal pyramid reflection devices disposed on an outer surface of the bump-resisting rigid casing, a transparent layer enclosing the outer surface of the bump-resisting rigid casing and the trigonal pyramid reflection devices, and a foamed layer disposed in the bump-resisting rigid casing. A plurality of air inlets are formed on a top front portion of the bump-resisting rigid casing. A plurality of channels are formed on a top portion of the bump-resisting rigid casing. A plurality of vent holes are formed on the top portion of the bump-resisting rigid casing and communicated with the channels. A plurality of hollow frames are inserted in the air inlets. A plurality of door plates covers the air inlets. Each of the door plates is inserted in the respective hollow frame. The bump-resisting rigid casing is made of nylon materials. The transparent layer is made of polyvinyl chloride materials. The foamed layer is made of ethylene/vinyl acetate materials. A fluorescence film is applied on each trigonal pyramid reflection devices.

In accordance with a second preferred embodiment of the present invention, a safety cap comprises a bump-resisting rigid casing, a plurality of trigonal pyramid reflection devices disposed on an outer surface of the bump-resisting rigid casing, a transparent layer enclosing the outer surface of the bump-resisting rigid casing and the trigonal pyramid reflection devices, and a foamed layer disposed in the bump-resisting rigid casing. A plurality of air inlets are formed on a top front portion of the bump-resisting rigid casing. A plurality of channels are formed on a top portion of the bump-resisting rigid casing. A plurality of vent holes are formed on the top portion of the bump-resisting rigid casing and communicated with the channels. A plurality of hollow frames are inserted in the air inlets. A plurality of door plates covers the air inlets. Each of the door plates is inserted in the respective hollow frame. The bump-resisting rigid casing is made of nylon materials. The transparent layer is made of polyvinyl chloride materials. The foamed layer is made of ethylene/vinyl acetate materials. A fluorescence film is applied on each trigonal pyramid reflection devices. A plurality of round holes are formed on a rear portion of the bump-resisting rigid casing. A plurality of light-emitting diodes are inserted in the round holes. A through hole is formed on a side of the bump-resisting rigid casing. An earphone is inserted in the through hole. An oblong hole is formed on a front lower portion of the bump-resisting rigid casing. A microphone is inserted in the oblong hole. A battery chamber is formed on the bump-resisting rigid casing. A lithium/nickel battery is disposed in the battery chamber. A cover covers the battery chamber. A switch is disposed on the cover.

DETAILED DESCRIPTION OF THE INVENTION

Figure 1:
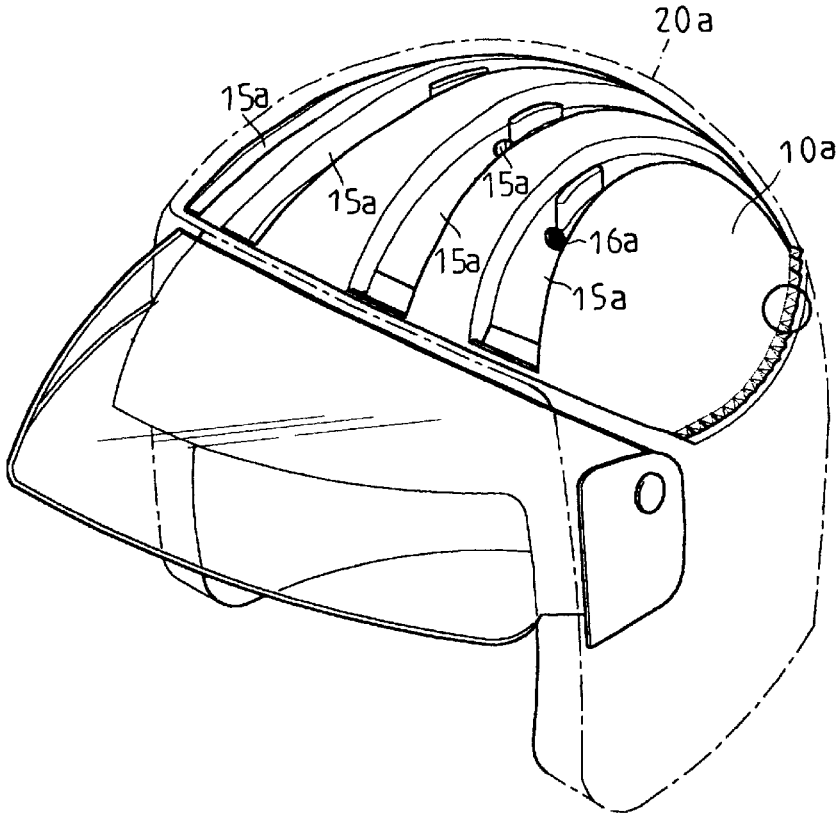
FIG. 1 is a schematic view of a safety cap of a preferred embodiment in accordance with the present invention.
Figure 1A:
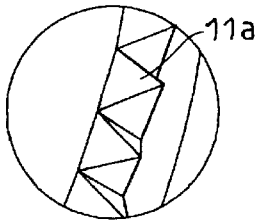
FIG. 1A is a perspective view of a plurality of trigonal pyramid reflection devices of a preferred embodiment in accordance with the present invention.
Figure 1B:
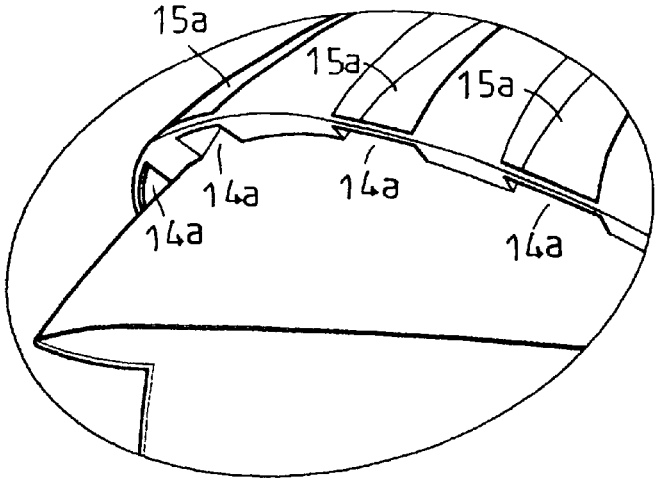
FIG. 1B is a front perspective view of a safety cap of a preferred embodiment without a door plate nor a hollow frame.
Figure 1C:
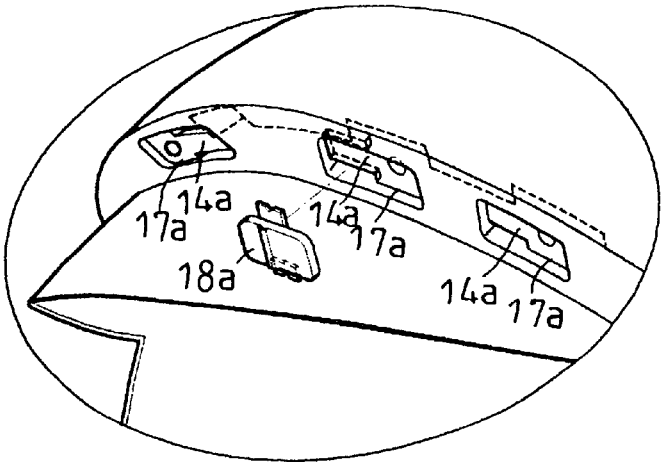
FIG. 1C is a front perspective view of a safety cap of a preferred embodiment with a door plate and a hollow frame.

Referring to FIGS. 1, 1A, 1B and 1C, a first safety cap comprises a bump-resisting rigid casing 10*a*, a plurality of trigonal pyramid reflection devices 11*a* disposed on an outer surface of the bump-resisting rigid casing 10*a*, a transparent layer 20*a* enclosing the outer surface of the bump-resisting rigid casing 10*a* and the trigonal pyramid reflection devices 11*a*, and a foamed layer 30*a* disposed in the bump-resisting rigid casing 10*a*.

A plurality of air inlets 14*a* are formed on a top front portion of the bump-resisting rigid casing 10*a*.

A plurality of channels 15*a* are formed on a top portion of the bump-resisting rigid casing 10*a*.

A plurality of vent holes 16*a* are formed on the top portion of the bump-resisting rigid casing 10*a* and communicated with the channels 15*a*.

A plurality of hollow frames 17*a* are inserted in the air inlets 14*a*.

A plurality of door plates 18*a* covers the air inlets 14*a*.

Each of the door plates 18*a* is inserted in the respective hollow frame 17*a*.

The bump-resisting rigid casing 10*a* is made of nylon materials.

The transparent layer 20*a* is made of polyvinyl chloride (PVC) materials.

The foamed layer 30*a* is made of ethylene/vinyl acetate (EVA) materials.

A fluorescence film 12*a* is applied on each trigonal pyramid reflection devices 11*a*.

The advantages of the present invention are described as follows.

The PVC transparent layer will be deformed while bumping.

The EVA foamed layer will be deformed elastically and will absorb shocks while bumping.

The bump-resisting rigid casing protects the safety cap from cracking.

The trigonal pyramid reflection devices will reflect lights.

The fluorescence films will illuminate fluorescent lights.

Figure 2:
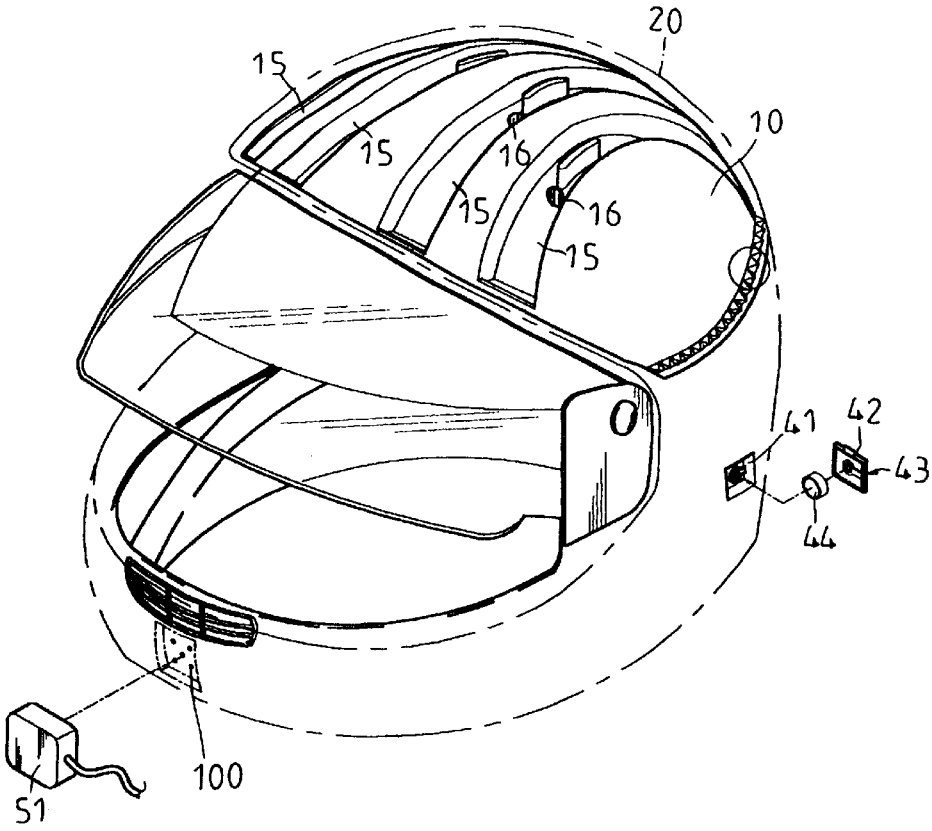
FIG. 2 is a schematic view of a safety cap of another preferred embodiment in accordance with the present invention.
Figure 2A:
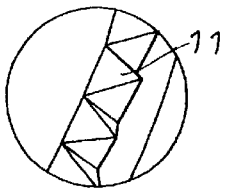
FIG. 2A is a perspective view of a plurality of trigonal pyramid reflection devices of another preferred embodiment in accordance with the present invention.
Figure 2B:
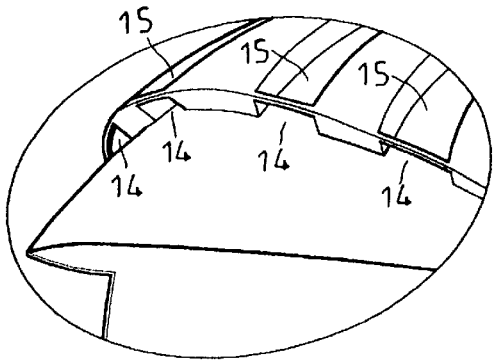
FIG. 2B is a front perspective view of a safety cap of another preferred embodiment without a door plate nor a hollow frame.
Figure 2C:
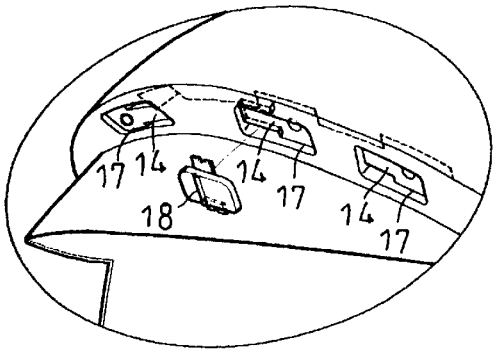
FIG. 2C is a front perspective view of a safety cap of another preferred embodiment with a door plate and a hollow frame.
Figure 2D:
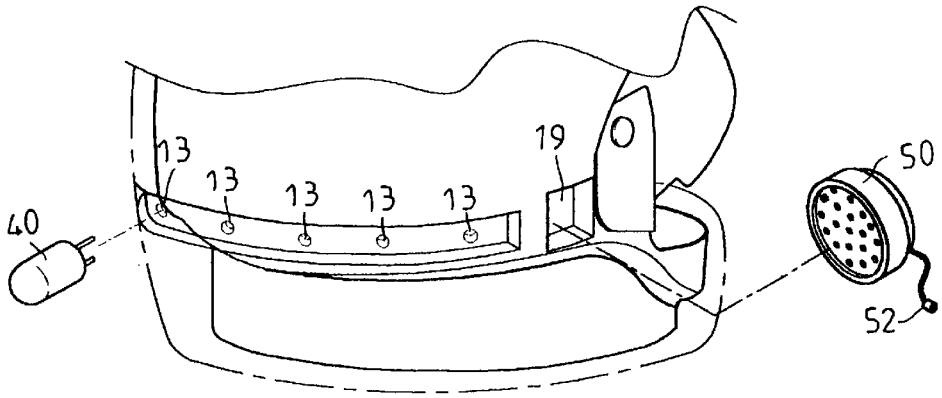
FIG. 2D is a rear view of a rear portion of a bump-resisting rigid casing.
Figure 3:
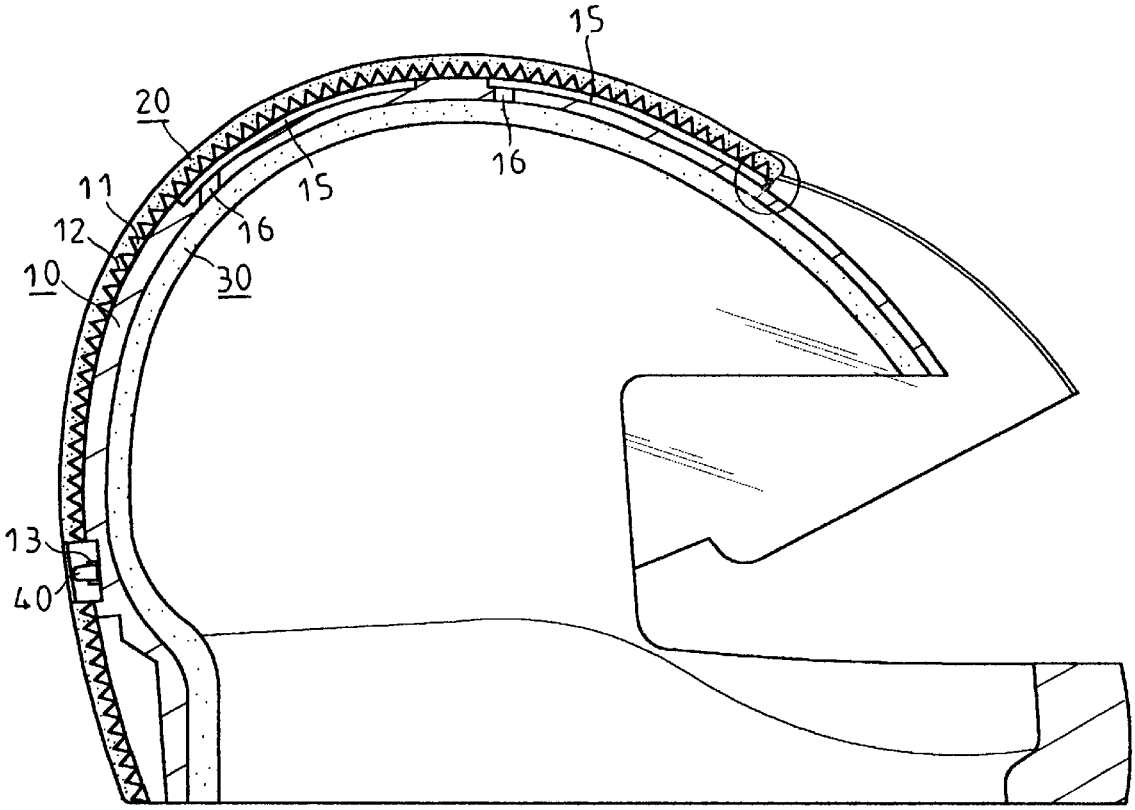
FIG. 3 is a sectional assembly view of a safety cap of another preferred embodiment in accordance with the present invention.
Figure 3A:
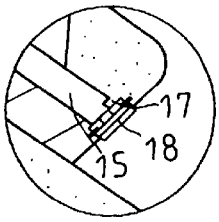
FIG. 3A is a schematic view illustrating a door plate engaging with a hollow frame of another preferred embodiment in accordance with the present invention.
Figure 4:
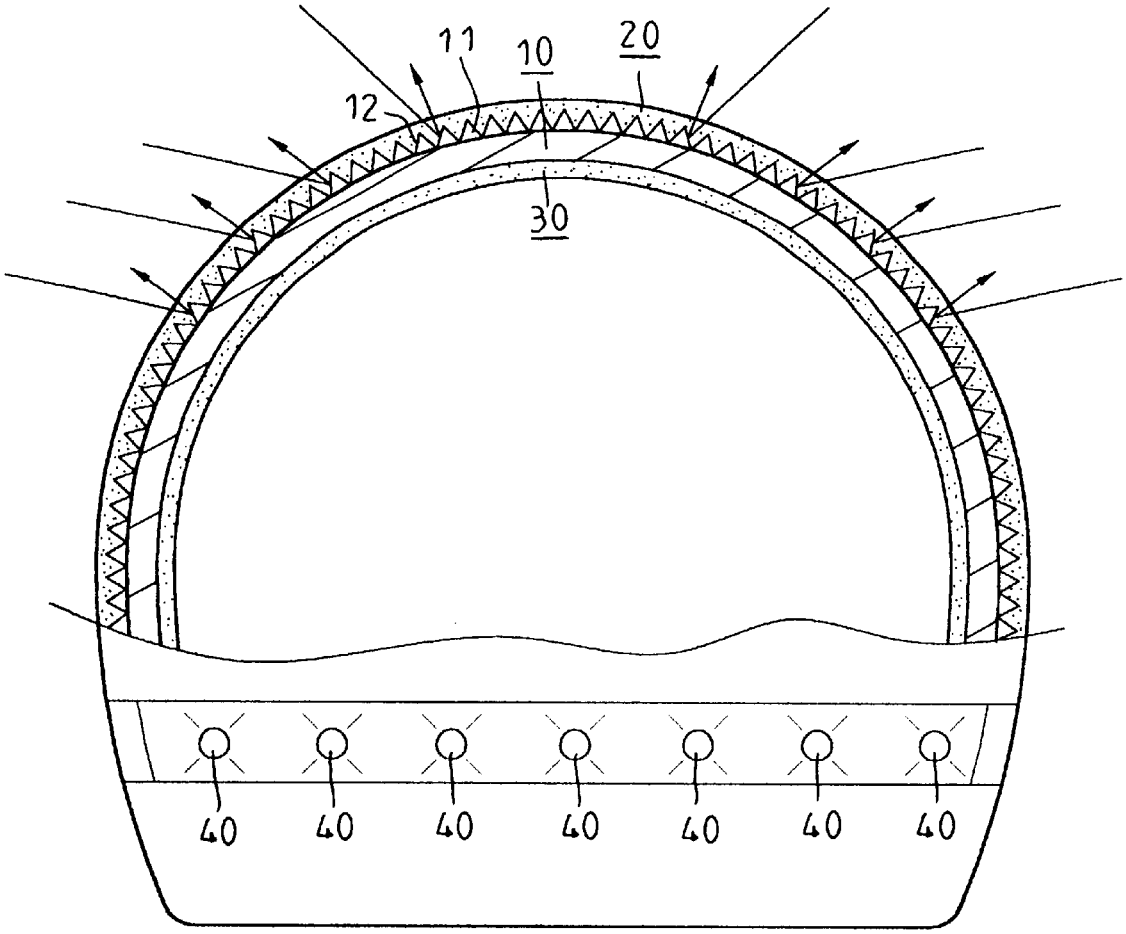
FIG. 4 is a schematic view illustrating an operation of a plurality of light-emitting diodes of another preferred embodiment in accordance with the present invention.
Figure 5:
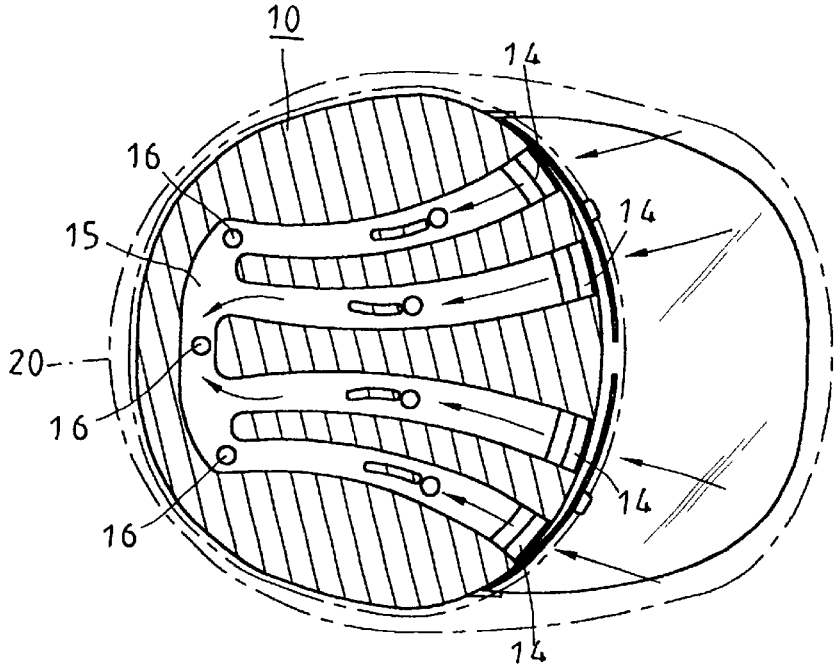
FIG. 5 is a schematic view illustrating an air flowing into a safety cap of another preferred embodiment in accordance with the present invention.
Figure 5A:
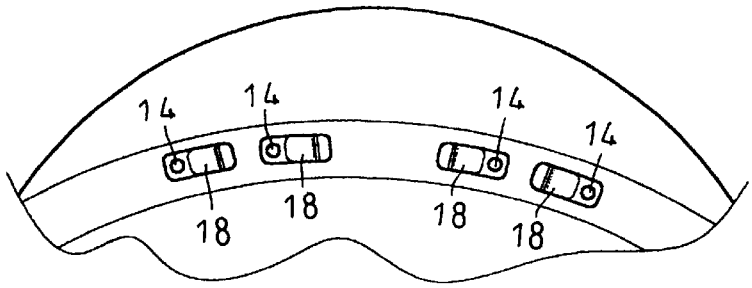
FIG. 5A is a schematic view illustrating a plurality of door plates engaging with a plurality of hollow frames of another preferred embodiment in accordance with the present invention.
Figure 6:
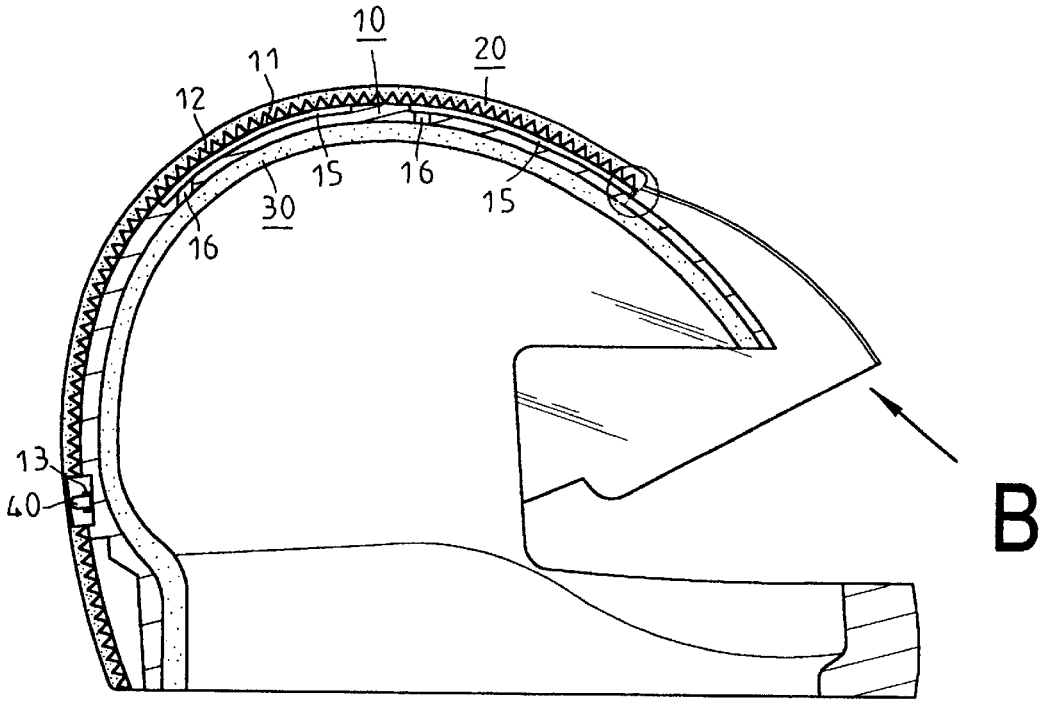
FIG. 6 is a sectional schematic view illustrating an air flowing into a safety cap of another preferred embodiment in accordance with the present invention.
Figure 6A:
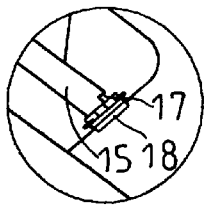
FIG. 6A is a schematic view illustrating an air flowing into an air inlet of another preferred embodiment in accordance with the present invention.
Figure 6B:
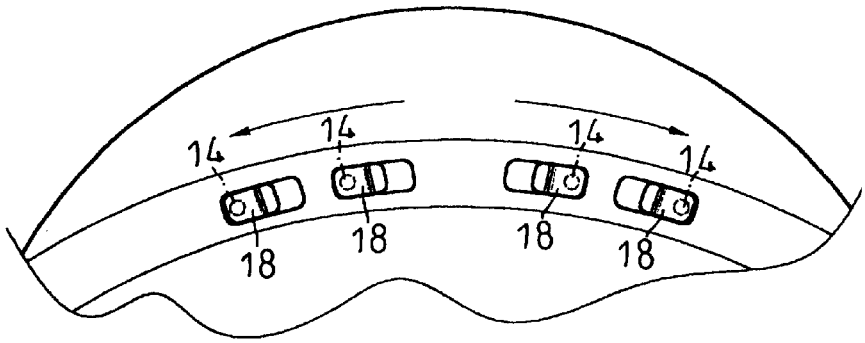
FIG. 6B is a schematic view illustrating an air flowing into a front portion of a bump-resisting rigid casing of another preferred embodiment in accordance with the present invention.
Figure 7:
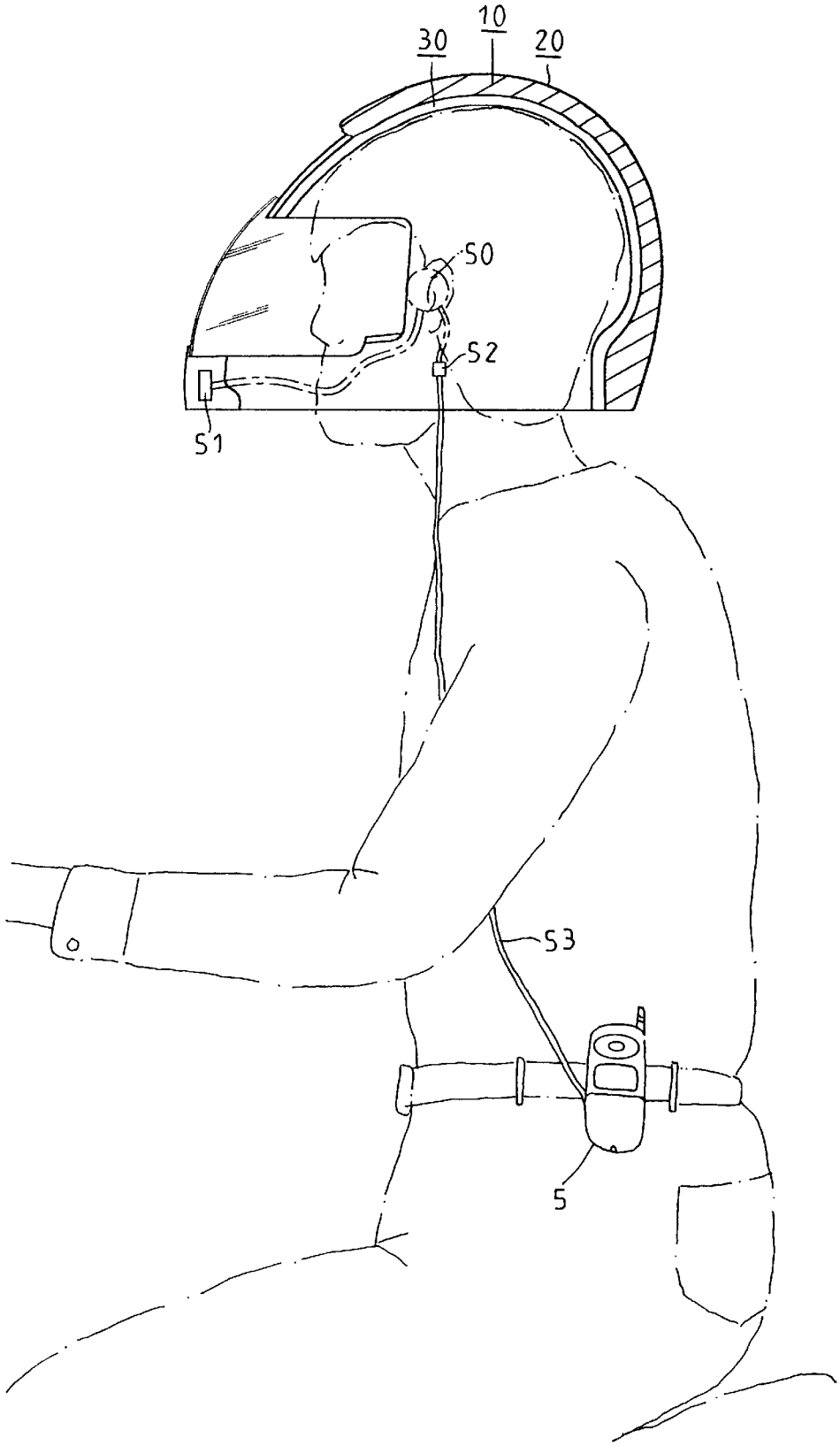
FIG. 7 is a schematic view illustrating an earphone disposed in a safety cap of another preferred embodiment in accordance with the present invention.

Referring to FIGS. 2 to 7, a second safety cap comprises a bump-resisting rigid casing 10, a plurality of trigonal pyramid reflection devices 11 disposed on an outer surface of the bump-resisting rigid casing 10, a transparent layer 20 enclosing the outer surface of the bump-resisting rigid casing 10 and the trigonal pyramid reflection devices 11, and a foamed layer 30 disposed in the bump-resisting rigid casing 10.

A plurality of air inlets 14 are formed on a top front portion of the bump-resisting rigid casing 10.

A plurality of channels 15 are formed on a top portion of the bump-resisting rigid casing 10.

A plurality of vent holes 16 are formed on the top portion of the bump-resisting rigid casing 10 and communicated with the channels 15.

A plurality of hollow frames 17 are inserted in the air inlets 14.

A plurality of door plates 18 covers the air inlets 14.

Each door plate 18 is inserted in the respective hollow frame 17.

The bump-resisting rigid casing 10*a* is made of nylon materials.

The transparent layer 20*a* is made of polyvinyl chloride (PVC) materials.

The foamed layer 30*a* is made of ethylene/vinyl acetate (EVA) materials.

A fluorescence film 12*a* is applied on each trigonal pyramid reflection device 11*a*.

A plurality of round holes 13 are formed on a rear portion of the bump-resisting rigid casing 10. A plurality of light-emitting diodes 40 are inserted in the round holes 13.

A through hole 19 is formed on a side of the bump-resisting rigid casing 10. An earphone 50 is inserted in the through hole 19. A wire 521 is connected to a plug 52 and the earphone 50. A connection wire 53 is connected to the plug 52 and a mobile phone 5.

An oblong hole 100 is formed on a front lower portion of the bump-resisting rigid casing 10. A microphone 51 is inserted in the oblong hole 100.

A battery chamber 41 is formed on the bump-resisting rigid casing 10. A lithium/nickel battery 44 is disposed in the battery chamber 41. A cover 42 covers the battery chamber 41. A switch 43 is disposed on the cover 42.

The advantages of the present invention are described as follows.

The PVC transparent layer will be deformed while bumping.

The EVA foamed layer will be deformed elastically and will absorb shocks while bumping.

The bump-resisting rigid casing protects the safety cap from cracking.

The trigonal pyramid reflection devices will reflect lights.

The fluorescence films will illuminate fluorescent lights.

The light-emitting diodes produce warning lights to warn passengers and vehicle drivers.

The present invention is not limited to the above embodiments but various modification thereof may be made. Furthermore, various changes in form and detail may be made without departing from the scope of the present invention.

I claim:

1. A safety cap comprises:

a bump-resisting rigid casing, a plurality of trigonal pyramid reflection devices disposed on an outer surface of the bump-resisting rigid casing, a transparent layer enclosing the outer surface of the bump-resisting rigid casing and the trigonal pyramid reflection devices, and a foamed layer disposed in the bump-resisting rigid casing, a plurally of air inlets formed on a top front portion of the bump-resisting rigid casing, a plurally of channels formed on a top portion of the bump-resisting rigid casing, a plurality of vent holes formed on the top portion of the bump-resisting rigid casing and communicated with the channels, a plurality of hollow frames inserted in the air inlets, a plurality of door plates covering the air inlets, and each said door plate inserted in the respective hollow frame.

2. A safety cap as claimed in claim 1, wherein the bump-resisting rigid casing is made of nylon materials.

3. A safety cap as claimed in claim 1, wherein the transparent layer is made of polyvinyl chloride materials.

4. A safety cap as claimed in claim 1, wherein the foamed layer is made of ethylene/vinyl acetate materials.

5. A safety cap as claimed in claim 1, wherein a fluorescence film is applied on each said trigonal pyramid reflection devices.

6. A safety cap as claimed in claim 1, wherein a plurality of round holes are formed on a rear portion of the bump-resisting rigid casing, and a plurality of light-emitting diodes are inserted in the round holes.

7. A safety cap as claimed in claim 1, wherein a through hole is formed on a side of the bump-resisting rigid casing, and an earphone is inserted in the through hole.

8. A safety cap as claimed in claim 1, wherein an oblong hole is formed on a front lower portion of the bump-resisting rigid casing, and a microphone is inserted in the oblong hole.

9. A safety cap as claimed in claim 1, wherein a battery chamber is formed on the bump-resisting rigid casing, a battery is disposed in the battery chamber, a cover covers the battery chamber, and a switch is disposed on the cover.

* * * * *